United States Patent [19]

Murphy

[11] Patent Number: 4,498,384

[45] Date of Patent: Feb. 12, 1985

[54] DIE TRANSFER SYSTEM

[76] Inventor: William P. Murphy, 1067 Kennesaw Ave., Birmingham, Mich. 48008

[21] Appl. No.: 511,548

[22] Filed: Jul. 7, 1983

[51] Int. Cl.[3] ..... B30B 15/02

[52] U.S. Cl. ..... 100/224; 72/448; 100/918; 193/35 SS; 414/531

[58] Field of Search ..... 100/918, 221, 224, 269 A; 193/35 SS; 414/532, 535, 531; 72/448

[56] References Cited

U.S. PATENT DOCUMENTS

| | | | |
|---|---|---|---|
| 2,975,701 | 3/1961 | Munschauer, Jr. et al. | 100/224 X |
| 3,002,479 | 10/1961 | Johansen et al. . | |
| 3,010,698 | 11/1961 | Allen et al. . | |
| 3,011,665 | 12/1961 | Wise | 414/535 |
| 3,207,065 | 9/1965 | Danly | 100/918 X |
| 3,230,812 | 1/1966 | Pucci et al. . | |
| 3,439,790 | 4/1969 | Langley et al. | 414/531 X |
| 3,455,141 | 7/1969 | Bracco et al. . | |
| 3,754,492 | 8/1973 | Krauss . | |
| 4,151,736 | 5/1979 | Quaas . | |
| 4,154,272 | 5/1979 | Huffman, Jr. . | |
| 4,273,738 | 6/1981 | Spengler . | |
| 4,301,673 | 11/1981 | Yonezawa | 100/918 X |
| 4,459,909 | 4/1982 | Takagi | 72/448 X |

FOREIGN PATENT DOCUMENTS

| | | | |
|---|---|---|---|
| 120181 | 9/1979 | Japan | 414/535 |
| 124416 | 9/1979 | Japan | 414/532 |
| 1002355 | 8/1965 | United Kingdom | 193/35 SS |
| 2094743 | 9/1982 | United Kingdom | 193/35 SS |
| 196525 | 5/1967 | U.S.S.R. | 100/918 |

*Primary Examiner*—Billy J. Wilhite
*Attorney, Agent, or Firm*—Lyman R. Lyon

[57] ABSTRACT

The disclosure relates to a die transfer system for a press having a bolster for the support of a die. The system comprises a pair of elongated, parallel upwardly opening cavities having horizontally extending vertically movable rails therein. A plurality of rollers are supported by each rail so as to be movable vertically therewith. An air bag extends longitudinally of each of said cavities under said rails and is engageable with the bottom thereof. Inflation of the air bags effects elevation of the rails and rollers into engagement with the bottom of the die and elevation of the die relative to the press bolster.

1 Claim, 8 Drawing Figures

DIE TRANSFER SYSTEM

BACKGROUND OF THE INVENTION

Relatively heavy stamping and injection molding dies present a handling problem when such dies are assembled with or removed from the bolster of a press. The problem is complicated by the fact that the press generally has a ram or other superstructure mounted directly over the die support bolster precluding vertical lift of the die or die set by a conventional crane.

Attempts to facilitate movement of a die set laterally with respect to the bolster of a press have heretofore required relatively complex and fragile systems that are not compatible with the heavy duty components utilized in such presses.

SUMMARY OF THE INVENTION

The die transfer system of the instant invention is relatively rugged and simple in construction. Roller supporting rails are orientated in spaced, parallel relation either above the upper surface of the conventional bolster of a press or, in another embodiment, in cavities milled into the bolster of the press.

In both embodiments, an air bag is disposed under each rail which, upon inflation effects elevation of the rail. Elevation of each rail is controlled by stops at each end thereof which positively limit upward movement of the rail and therefore the degree of elevation of the die. Upon elevation, the die is free to move in a direction parallel to the rails.

DETAILED DESCRIPTION OF THE PREFERRED EMBODIMENT OF THE INVENTION

Figure 1:
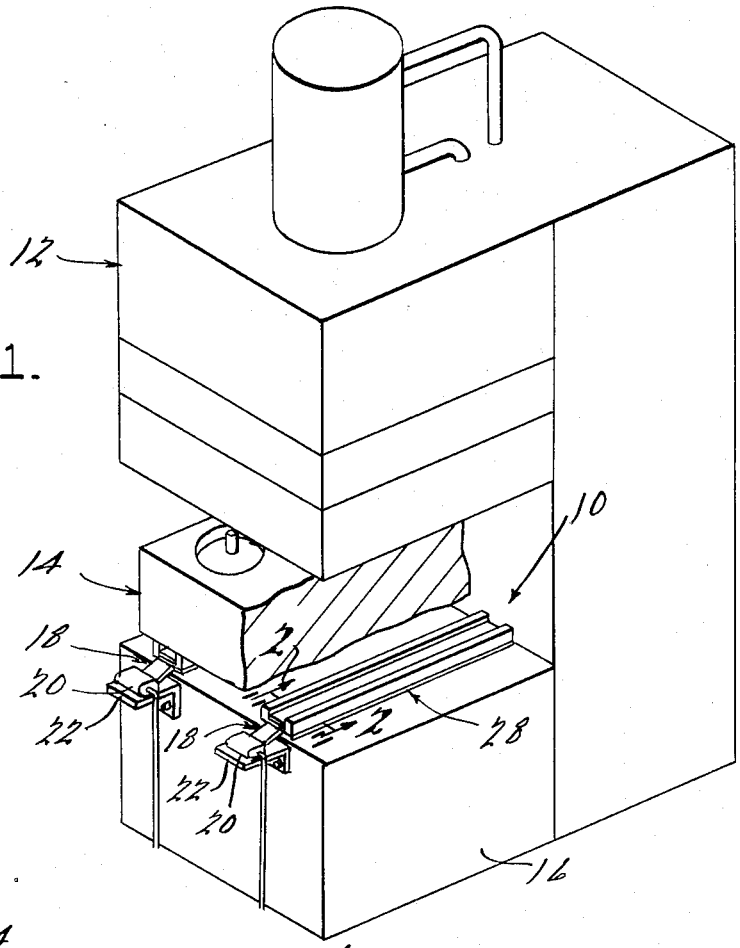
FIG. 1 is a perspective view of a press incorporating the die transfer system of the instant invention.

As seen in FIG. 1 of the drawing, a die transfer system 10, in accordance with an exemplary constructed embodiment of the instant invention, is adapted to be used with a heavy duty press 12 to facilitate movement of die 14 on and off a bolster 16 of the press 12. The transfer system 10 comprises an air bag 18 adapted to be energized by air at conventional shop pressures, for example, 50–100 lbs. per square inch. An inlet valve 20 is supported by a bracket 22 that is secured to the bolster 16 of the press 12.

Figure 2:
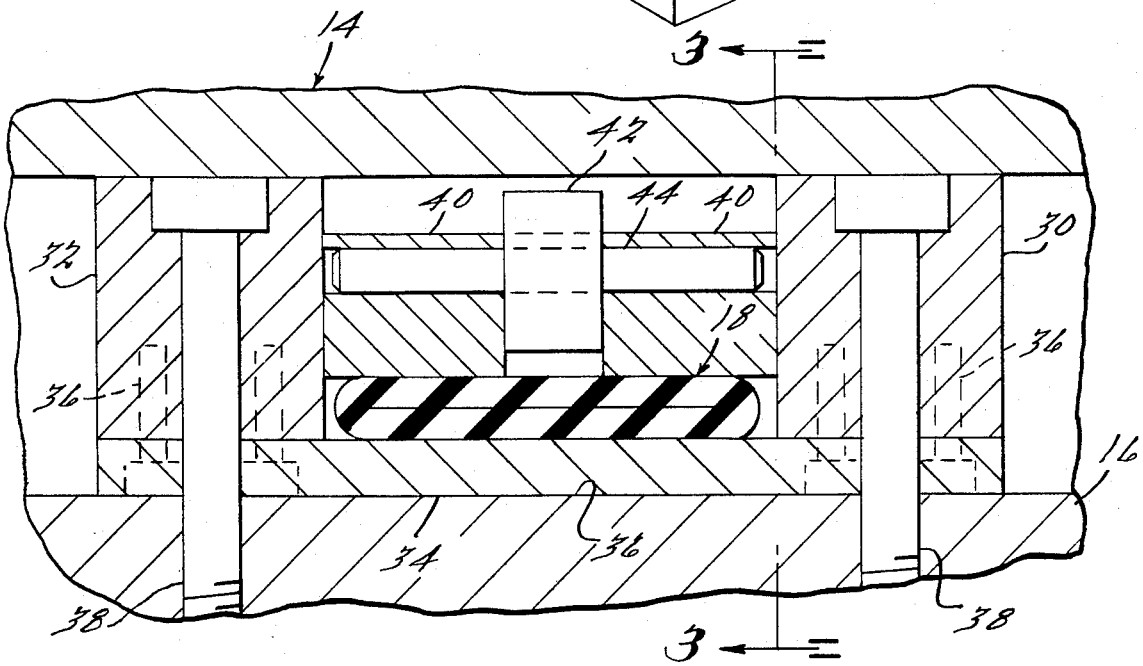
FIG. 2 is a view taken along the line 2—2 of FIG. 1.
Figure 3:
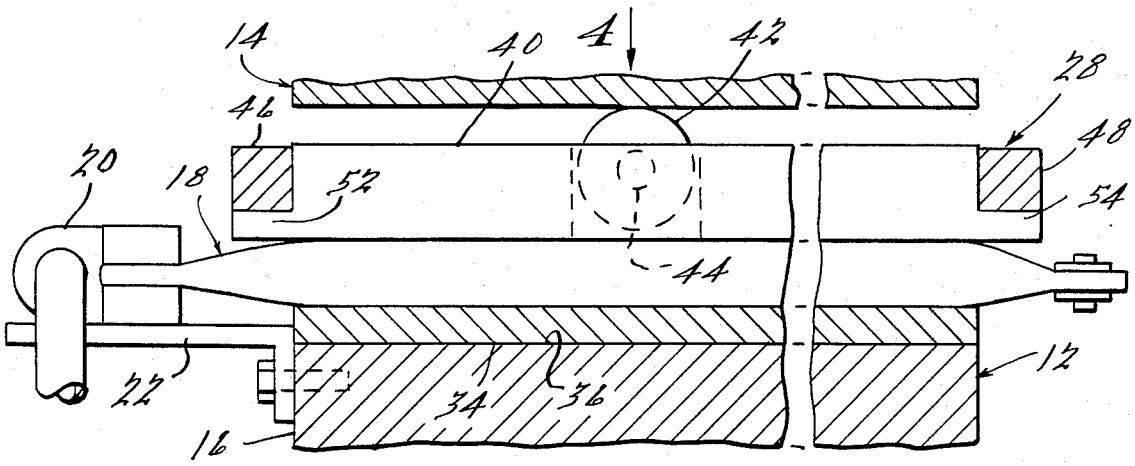
FIG. 3 is a view taken substantially along the line 3—3 of FIG. 2.
Figure 4:
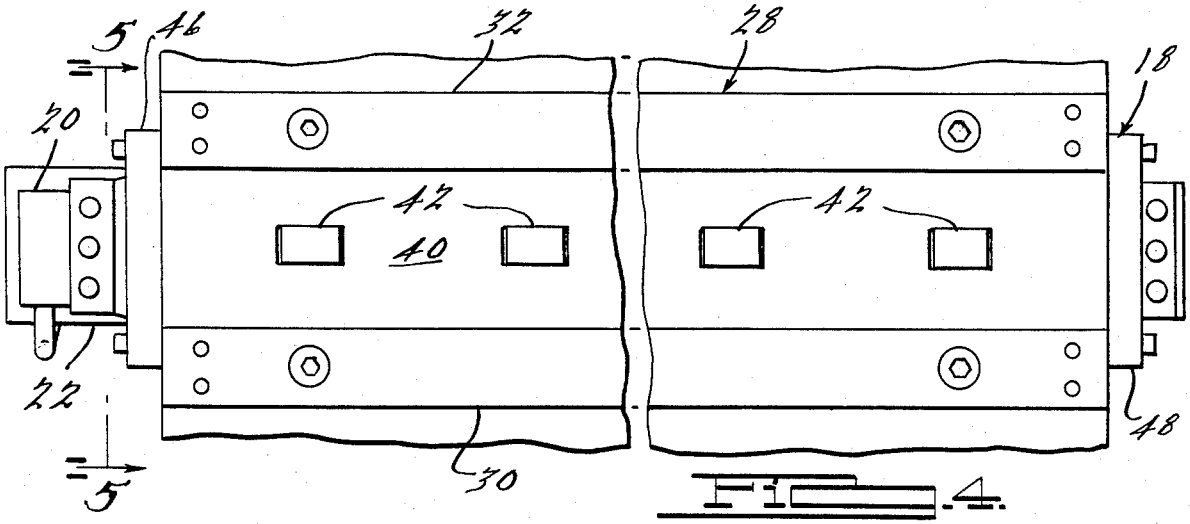
FIG. 4 is a view taken in the direction of the arrow 4 of FIG. 3.
Figure 5:
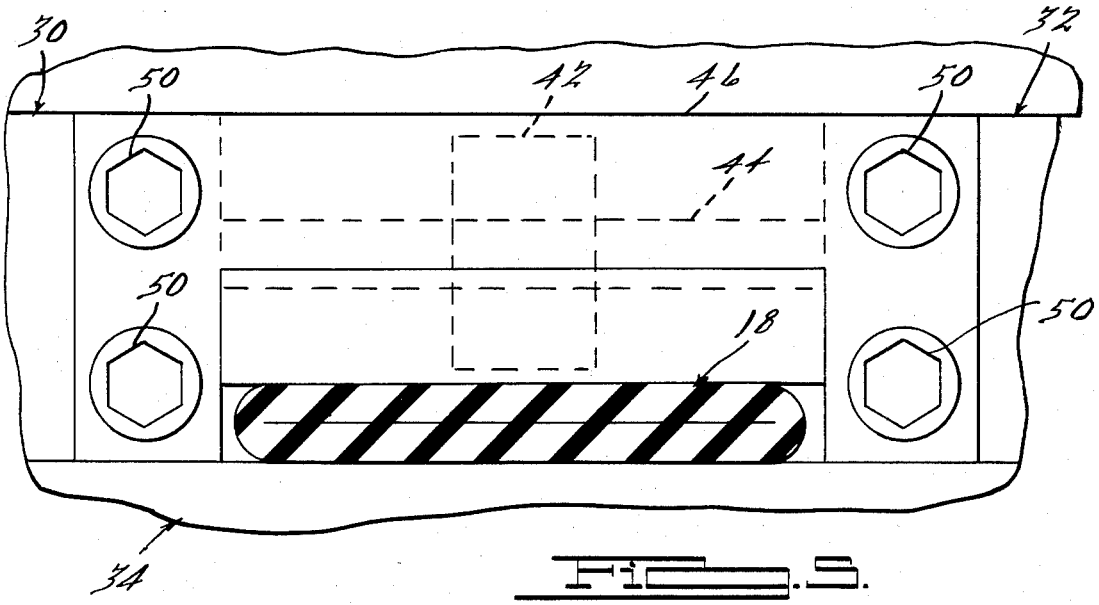
FIG. 5 is a view taken substantially along the line 5—5 of FIG. 4.

As best seen in FIGS. 2, 3 and 4 of the drawings, each rail assembly 28 comprises a pair of side frames 30 and 32 that are secured to a bottom plate 34 as by a plurality of bolts 36. The frames 30 and 32 and bottom plate 34 are secured to an upper surface 36 of the bolster 16 by machine screws 38.

Each air bag 18 supports a rail 40 having a plurality of rolls 42 thereon. The rolls 42 are journaled on shafts 44 so as to elevate and support the die 14 for movement upon energization of the air bag 18 and elevation of the rails 40.

Upward movement of the rail 40 is limited by a pair of U-shaped stops 46 and 48 at opposite ends of the rail 40, end portions 52 and 54 of the rails 40 extending under the bight portion of the U-shaped stops 46 and 48. The stops 46 and 48 are secured to the side frames 30 and 32 as by bolts 50.

Figure 6:
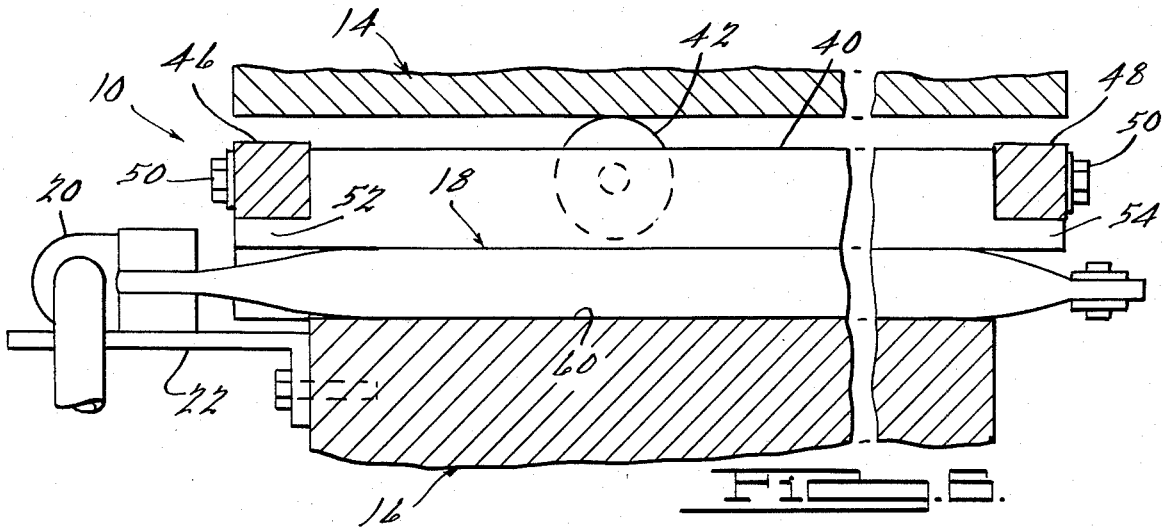
FIG. 6 is a sectional view, similar to FIG. 3, of the die transfer system of the instant invention shown mounted in a slot milled in the bolster of a press and with the air bag in the inflated condition.
Figure 7:
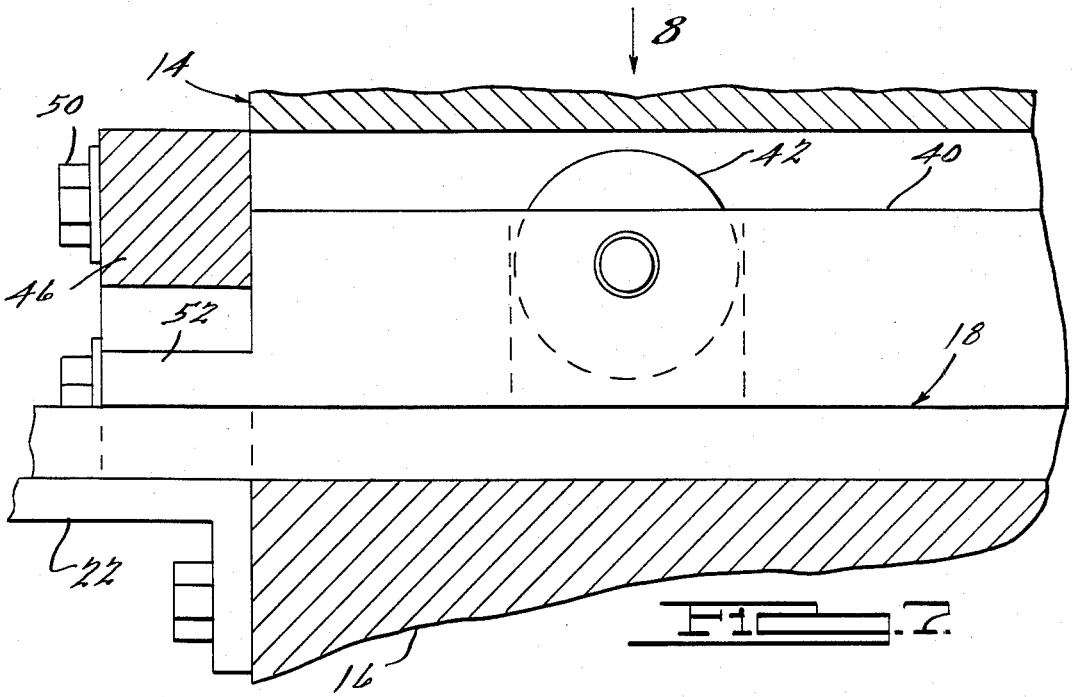
FIG. 7 is a view, similar to FIG. 6, with the rail of the transfer system and air bag in the down and deflated position, respectively.
Figure 8:
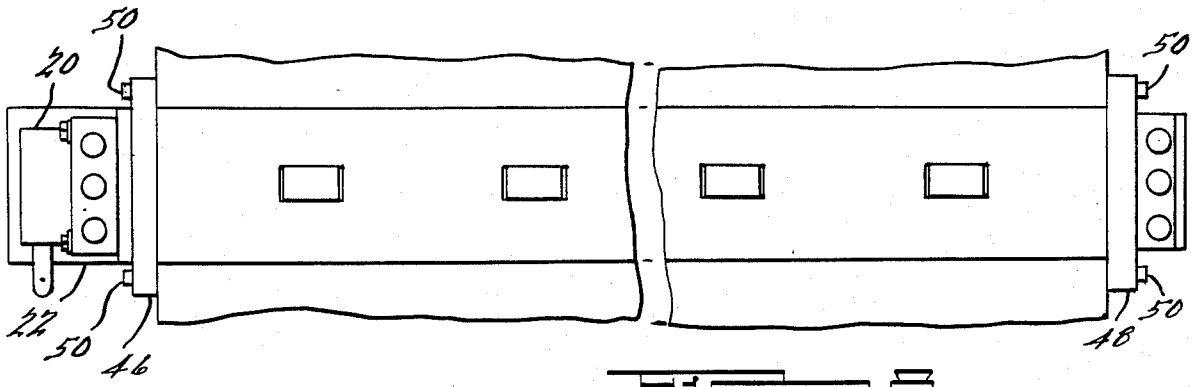
FIG. 8 is a view taken in the direction of the arrow 8 of FIG. 7.

In accordance with the embodiment of the instant invention illustrated in FIGS. 6–8, two or more spaced, parallel channels 60 are milled into the bolster 16 for the acceptance of the air bags 18 and the rails 40. As in the embodiment illustrated in FIGS. 1–5, the rails 40 are provided with a plurality of rollers 42 that are journaled on shafts 44, respectively. The rollers 42 are adapted to engage the bottom surface of the die 14 to effect elevation thereof.

Upward movement of the rails 40 is limited by the U-shaped stops 46 and 48 at opposite ends of each milled channel 60. In this embodiment, the U-shaped stops 46 and 48 are secured directly to the bolster 16 by the bolts 50. The end portions 52 and 54 of the rail 40 are engageable under the U-shaped stops 46 and 48 to limit elevation of the rail 40 due to inflation of the air bag 18.

Operation of the die transfer system 10 is best visualized by comparing FIGS. 6 and 7. FIG. 6 illustrates the air bag 18 in the inflated condition and the rail 40 and rollers 42 thereon elevated into engagement with the die 14 to effect elevation thereof. FIG. 7 illustrates the air bag 18 in the collapsed or deenergized condition and the rail 40 in its lowermost position wherein the upper surface of each roll 42 is disposed below the lower surface of the die 14 permitting the die 14 to rest upon the bolster 16 or side frames 28 and 30.

The difference between the embodiment shown in FIGS. 1–5 and the embodiment illustrated in FIGS. 6–8 is that the latter embodiment requires milling of the bolster 16 of the press 12 to provide slots for the acceptance of the air bags 18 and rails 40; whereas, in the embodiment illustrated in FIGS. 1–5, the assembly is attachable directly to the upper surface of an existing press bolster thereby eliminating the requirement for milling of parallel grooves in the bolster.

From the foregoing description it should be apparent that the die transfer system of the instant invention is relatively simple, yet rugged in construction. It is operable to effect elevation of relatively heavy die sets so as to condition them for lateral movement on the rolls of the transfer system.

The system is practical for die sets weighing from 1–80 tons. In a working embodiment, the lift rails 40 have 3900# rollers on 6-inch centers. Lift is accomplished by air bag rated at 500 psi under the rail 40. When actuated to "on", the rail 40 lifts $\frac{3}{8}$ inch to raise rollers 42 $\frac{1}{4}$ inch above the top face of the side frames 30 and 32 or top 36 of the bolster 16. Lift capacity is approximately 2500# per running foot, depending on psi input. The coefficient of rolling friction on the rollers is 0.007, so that a 10,000# die set requires only 70# push force to effect lateral movement thereof.

To determine rail length for a given application, rail length, in inches is multiplied by 2.4375×psi which equals lift force of rail. For example, a 48 inch long rail×2.4375×90 psi=10,530# lift force. If the heaviest die set for a given press is 25,000# it would require three rails giving a total of 31,590# lift.

Air consumption is approximately 1/20 cu. ft. per running foot of rail. Specifically, 0.578 cu. ft. at 100 psi, and 0.0477 cu. ft. at 80 psi. Therefore, as an example, a 40,000# die set using approximately 20 feet of rail, would use 1 cu. ft. of air to fill the system.

While the preferred embodiment of the invention has been disclosed, it should be appreciated that the invention is susceptible of modification without departing from the scope of the following claims.

I claim:

1. A die transfer system for a press having a bolster with a surface for the support of a die, said system comprising means on said bolster defining a pair of elongated, parallel upwardly opening cavities, each of said cavities having a horizontally extending vertically movable rail therein with oppositely longitudinally extending ends at the lowermost portions thereof, a plurality of rollers supported by said rail and movable vertically therewith, an air bag extending longitudinally of said cavities under said rail and engageable with the bottom thereof, inflation of said air bag effecting elevation of said rail and rollers into engagement with the bottom of said die and elevation of said die relative to said bolster, and limiting means engageable with said rail to limit upward movement thereof comprising a pair of inverted U-shaped stops each defined by a horizontal uninterrupted bight portion and spaced downwardly extending leg portions, the bight portions of said stops overlying said opposite end portions of said rail but being disposed entirely below the die support surface of said press bolster.

* * * * *